US010018140B2

(12) United States Patent
Mano et al.

(10) Patent No.: US 10,018,140 B2
(45) Date of Patent: Jul. 10, 2018

(54) CONTROL DEVICE AND CONTROL METHOD FOR INTERNAL COMBUSTION ENGINE

(71) Applicant: Nissan Motor Co., Ltd., Yokohama-shi, Kanagawa (JP)

(72) Inventors: Tadaki Mano, Kanagawa (JP); Takatoshi Saitou, Kanagawa (JP); Kunpei Tomioka, Kanagawa (JP); Nobuyuki Edamatsu, Kanagawa (JP); Kohei Kubota, Kanagawa (JP); Daisei Nagaoka, Kanagawa (JP); Kazuyuki Kogiso, Kanagawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 15/564,274

(22) PCT Filed: Apr. 6, 2015

(86) PCT No.: PCT/JP2015/060698
§ 371 (c)(1),
(2) Date: Oct. 4, 2017

(87) PCT Pub. No.: WO2016/162911
PCT Pub. Date: Oct. 13, 2016

(65) Prior Publication Data
US 2018/0135552 A1 May 17, 2018

(51) Int. Cl.
*F02D 41/00* (2006.01)
*F02D 41/30* (2006.01)
(Continued)

(52) U.S. Cl.
CPC ..... *F02D 41/3094* (2013.01); *F02D 41/08* (2013.01); *F02D 41/3029* (2013.01);
(Continued)

(58) Field of Classification Search
CPC ..... F02D 41/3094; F02D 41/08; F02D 2200/1002; F02D 2200/101
See application file for complete search history.

(56) References Cited

U.S. PATENT DOCUMENTS 6,003,478 A * 12/1999 Huber ..... F02B 7/06 123/27 GE
7,150,266 B2 * 12/2006 Nakayama ..... B60K 6/24 123/431
(Continued)

FOREIGN PATENT DOCUMENTS

EP 1975397 A1 10/2008
JP 2000018137 A 1/2000
(Continued)

*Primary Examiner* — Hieu T Vo
*Assistant Examiner* — Sherman Manley
(74) *Attorney, Agent, or Firm* — Young Basile Hanlon & MacFarlane, P.C.

(57) ABSTRACT

Internal combustion engine has direct injection fuel injection valve and port injection fuel injection valve. A requested fuel injection amount is calculated according to an engine operation condition. When the requested fuel injection amount is in first operation region in which the minimum fuel injection amount of direct injection fuel injection valve is exceeded, a direct injection fuel injection valve fuel injection amount is adjusted based on the requested fuel injection amount and a fixed amount, while maintaining a port injection fuel injection valve fuel injection amount at the fixed amount. First operation region is at least a region in which the requested fuel injection amount exceeds the direct injection fuel injection valve minimum fuel injection amount. In first operation region, the port injection fuel injection valve fuel injection amount is fixed at the minimum fuel injection amount of port injection fuel injection valve.

6 Claims, 3 Drawing Sheets

(51) Int. Cl.
*F02D 41/08* (2006.01)
*F02M 51/06* (2006.01)

(52) U.S. Cl.
CPC ..... *F02D 2200/101* (2013.01); *F02D 2200/1002* (2013.01); *F02M 51/061* (2013.01)

(56) References Cited

U.S. PATENT DOCUMENTS 7,302,928 B2 * 12/2007 Satou ..... F02D 41/024 123/295
7,546,834 B1 * 6/2009 Ulrey ..... F02D 19/0628 123/525
7,640,914 B2 * 1/2010 Lewis ..... F02D 41/0025 123/431
7,647,916 B2 * 1/2010 Leone ..... F02D 41/0025 123/25 E
8,353,269 B2 * 1/2013 Kasseris ..... F02B 47/04 123/198 A
9,435,288 B2 * 9/2016 Cohn ..... F02D 41/3094
2006/0021595 A1 * 2/2006 Miyashita ..... F02D 41/3094 123/299
2006/0096576 A1 5/2006 Kinose
2007/0006849 A1 * 1/2007 Mashiki ..... F02D 41/406 123/457
2007/0017484 A1 * 1/2007 Kinose ..... F02D 41/3094 123/431
2007/0089697 A1 * 4/2007 Hara ..... F02D 35/023 123/90.15
2011/0162620 A1 * 7/2011 Bidner ..... F02D 41/0025 123/299
2014/0230792 A1 8/2014 Kawabe et al.
2014/0250869 A1 * 9/2014 Kawabe ..... F02D 41/401 60/285
2015/0267634 A1 * 9/2015 Mashiki ..... F02D 41/0057 123/295
2015/0322879 A1 * 11/2015 Zeng ..... F02D 41/3094 701/103
2016/0341143 A1 * 11/2016 Sanborn ..... F02D 41/047
2016/0348607 A1 * 12/2016 Ishimatsu ..... F02D 41/3094

FOREIGN PATENT DOCUMENTS

JP 2005113745 A 4/2005
JP 2005133632 A 5/2005
JP 2005133637 A 5/2005
JP 2005171821 A 6/2005
JP 2006194098 A 7/2006
JP 2006274923 A 10/2006
JP 2009191662 A 8/2009
JP 2010242689 A 10/2010
JP 2013108399 A 6/2013
JP 2013253558 A 12/2013
JP 2014159787 A 9/2014
WO 2008035190 A2 3/2008

* cited by examiner

CONTROL DEVICE AND CONTROL METHOD FOR INTERNAL COMBUSTION ENGINE

TECHNICAL FIELD

This invention relates to a control device and a control method for an internal combustion engine in which a fuel injection valve for direct injection for injecting fuel into a combustion chamber and a fuel injection valve for port injection for injecting fuel into an intake port are provided, as a fuel supply device.

BACKGROUND

An internal combustion engine in which a fuel injection valve for direct injection for injecting fuel into a combustion chamber and a fuel injection valve for port injection for injecting fuel into an intake port are provided has already been disclosed in Japanese Patent Application Publication 2000-18137. In Japanese Patent Application Publication 2000-18137, in a predetermined operation condition, the port injection fuel injection valve is operated, and fuel supply to the engine is shared by the direct injection fuel injection valve and the port injection fuel injection valve.

As mentioned above, in a case where the direct injection fuel injection valve and the port injection fuel injection valve are used in combination, as compared with a configuration in which one of the fuel injection valves covers the total fuel injection amount, it becomes possible to reduce the sizes of the fuel injection valves themselves, and the minimum fuel injection amounts of the fuel injection valves become small, and consequently, in particular, setting accuracy of the fuel injection amount in a region in which the fuel injection amount is small is improved. On the other hand, if the fuel injection amounts of the injection vales are individually controlled, the control becomes complicated, and it also becomes difficult to maintain the setting accuracy of the total fuel injection amount. In addition, as to the direct injection, as compared with the port injection, it is superior in responsiveness and controllability, and fuel injection timing is close to ignition timing, and stratified charge combustion can be realized. Functionally, it is therefore preferable that the direct injection covers the total fuel injection amount. However, if an operation condition in which the port injection fuel injection valve is not operated is prolonged, operation failure tends to occur such as clogging of the port injection fuel injection valve.

SUMMARY

The present invention was made in consideration of such a problem. That is, in the present invention, a direct injection fuel injection valve and a port injection fuel injection valve are included, and a requested fuel injection amount is calculated and set according to an engine operation condition, and in a predetermined first operation region, the fuel injection amount of the direct injection fuel injection valve is adjusted and controlled on the basis of the requested fuel injection amount and a fixed amount, while maintaining the fuel injection amount of the port injection fuel injection valve at the fixed amount.

According to the present invention, in at least the first operation region, since the fixed amount of the injection is always performed by the port injection fuel injection valve, an operation stop period of the port injection fuel injection valve is suppressed from being prolonged, and occurrence of the clogging can be suppressed. In addition, since the fuel injection amount of the port injection fuel injection valve is set at the fixed amount, only the fuel injection amount of the direct injection fuel injection valve needs to be adjusted according to the engine operation condition, and the control of the fuel injection amount is simplified. Moreover, as compared with the port injection, most of the fuel injection amount is performed by the direct injection which is superior in responsiveness and controllability, and which is capable of realizing stratified charge combustion because fuel injection timing is close to ignition timing, and thereby controllability can be improved.

DETAILED DESCRIPTION OF THE EMBODIMENTS

Figure 1:
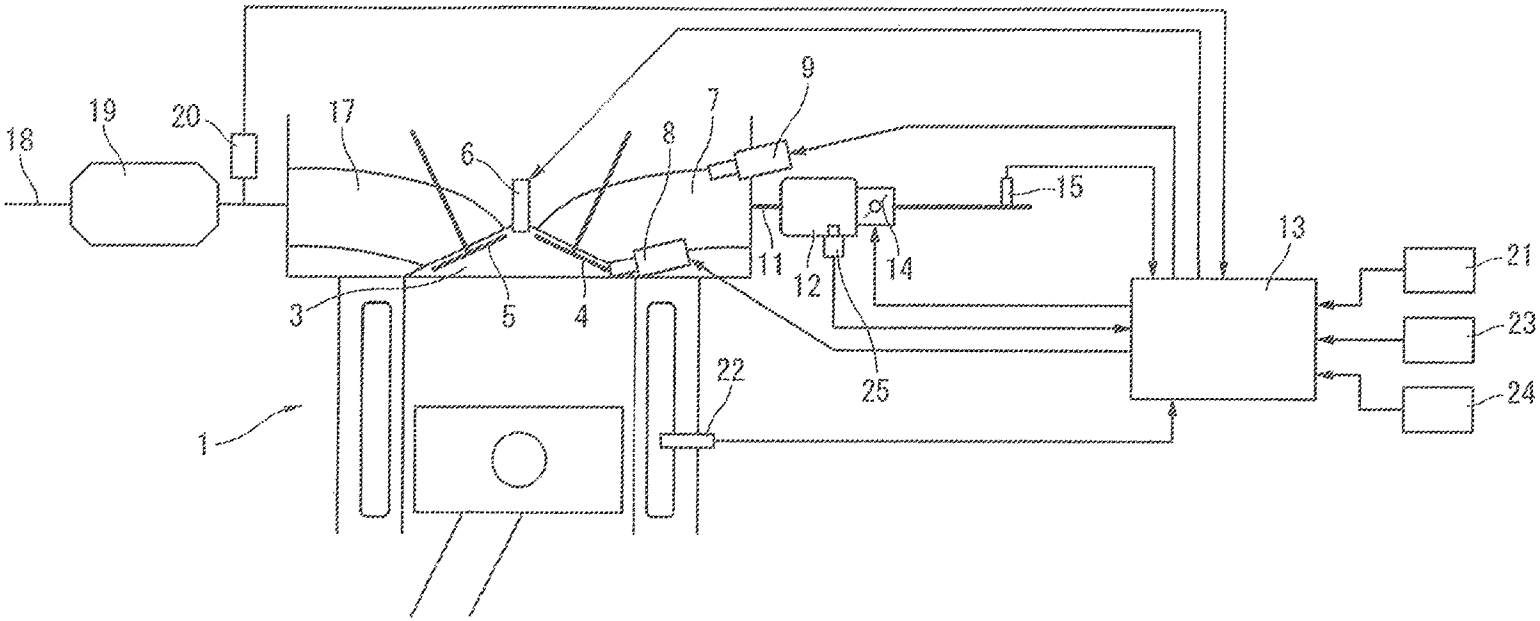
FIG. 1 is a configuration explanation drawing showing a system configuration of a control device according to one embodiment of the invention.

In the following, one embodiment of the present invention will be explained in detail based on the drawings. FIG. 1 shows a system configuration of an internal combustion engine 1 for an automobile in which the present invention is applied. This internal combustion engine 1 is, for example, a four-stroke cycle spark ignition internal combustion engine, and a pair of intake valves 4 and a pair of an exhaust valves 5 are disposed on the ceiling wall surface of a combustion chamber 3, and a spark plug 6 is disposed at the middle part surrounded by these intake valves 4 and exhaust valves 5.

As a main fuel injection valve, a fuel injection valve 8 for direct injection for directly injecting fuel into combustion chamber 3 is arranged below an intake port 7 which is opened/closed by intake valve 4. In addition, in intake port 7, as an auxiliary fuel injection valve, a fuel injection valve 9 for port injection for injecting the fuel toward the inside of intake port 7 is disposed in each cylinder. Each of these direct injection fuel injection valve 8 and port injection fuel injection valve 9 is an electromagnetic type or voltage type injection valve which is opened by receiving a drive pulse signal, and injects an amount of the fuel which is substantially proportional to the pulse width of the drive pulse signal.

An electronic control type throttle valve 14 whose opening degree is controlled by a control signal from an engine controller 13 is interposed at the upstream side of a collector portion 12 of an intake passage 11 connected to intake port 7, and an air flow meter 15 that detects the amount of intake air is arranged at the upstream side of electronic control valve type throttle valve 14.

In addition, a catalyst device 19 consisting of three-way catalyst is interposed at an exhaust passage 18 connected to an exhaust port 17, and at its upstream side, an air-fuel ratio sensor 20 that detects air-fuel ratio is disposed.

Engine controller 13 is inputted with detection signals of sensors such as, in addition to air flow meter 15 and air-fuel ratio sensor 20, a crank angle sensor 21 that detects the rotation speed of the engine, a water temperature sensor 22 that detects the temperature of cooling water, an accelerator opening sensor 23 that detects the depression amount of an accelerator pedal operated by a driver, a vehicle speed sensor 24 that detects the speed of a vehicle, an intake air temperature sensor 25 that detects the temperature of intake air in, for example, collector portion 12 of intake passage 11. The engine controller 13 optimally controls the amount of the fuel injection and injection timing by each of fuel injection valves 8 and 9, ignition timing by spark plug 6, the opening degree of throttle valve 14, etc., based on those detection signals.

A fuel injection amount ratio of the direct injection by direct injection fuel injection valve 8 to the port injection by port injection fuel injection valve 9 is controlled in accordance with the operation condition of the internal combustion engine 1 by engine controller 13.

Figure 2:
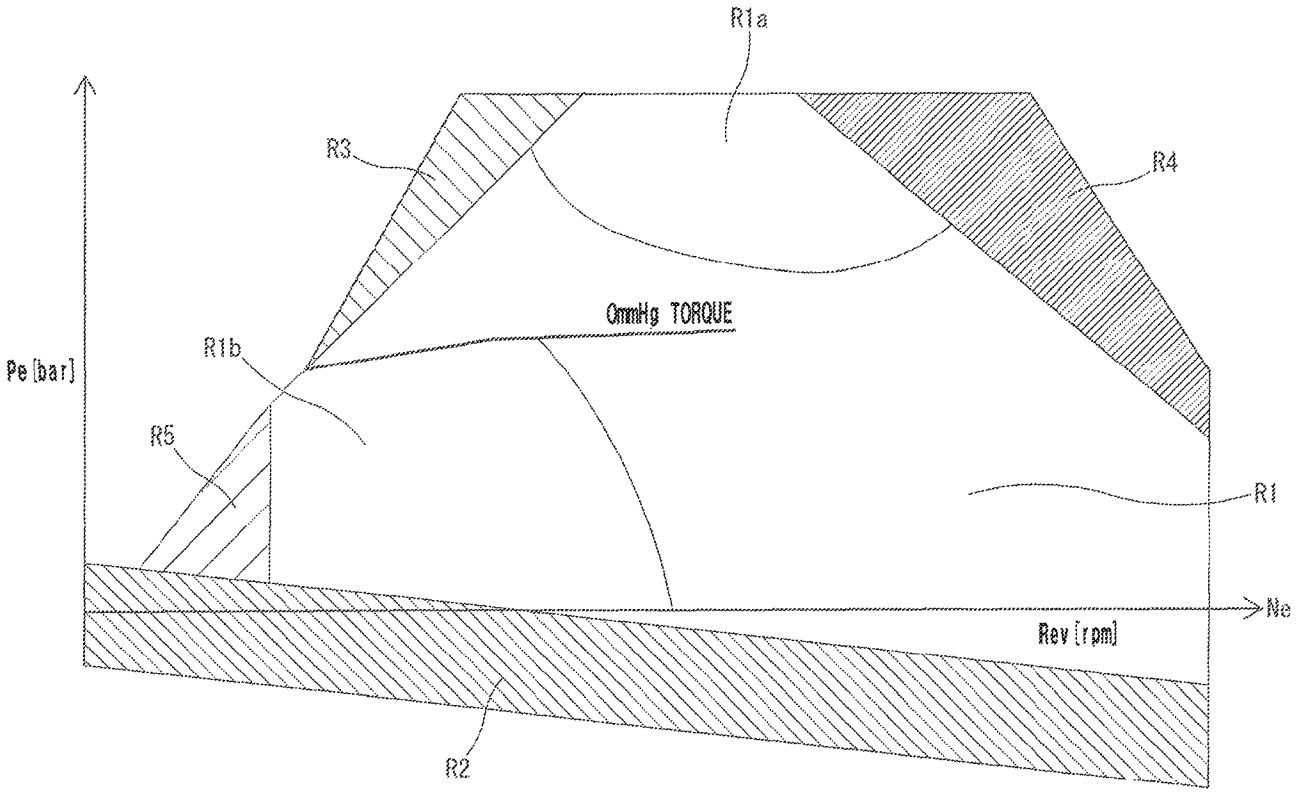
FIG. 2 is a characteristic diagram showing operation regions in which an injection mode is switched.

FIG. 2 shows operation regions in which the fuel injection amount ratio of a direct injection fuel injection amount to a port injection fuel injection amount is switched, in the operation regions of internal combustion engine 1 with a load and a rotation speed of internal combustion engine 1 as parameters. In addition, in the following explanation, "GDI" indicates the direct injection by direct injection fuel injection valve 8, and "MPI" indicates the port injection by port injection fuel injection valve 9.

Figure 3:
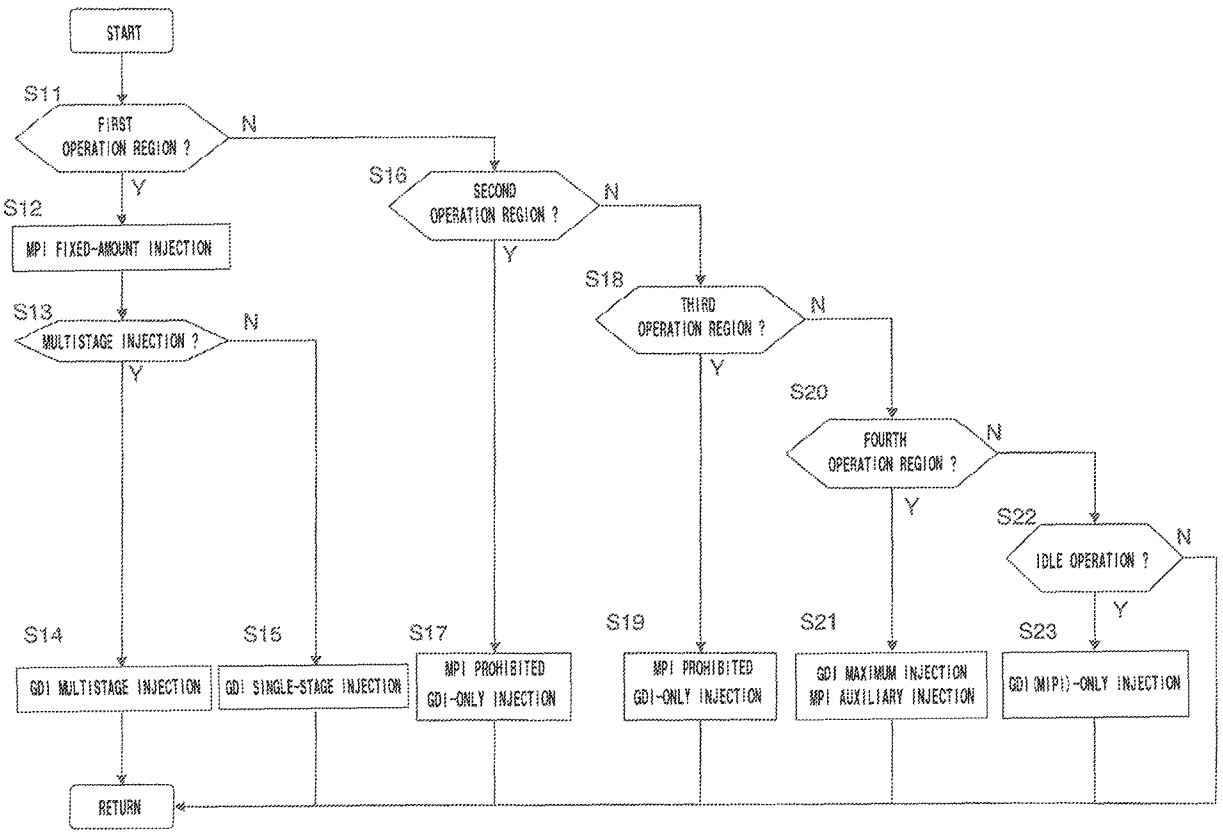
FIG. 3 is a flow chart showing a flow of control of the embodiment.

FIG. 3 is a flow chart showing a flow of control of the present embodiment, and this routine is stored and executed by engine controller 13.

In a step S11, it is judged whether or not the operation region is a first operation region R1. As shown in FIG. 2, this first operation region R1 occupies a large operation region that is a normal operation region except the after-mentioned operation regions R2 to R5.

In a case where the operation region is this first operation region R1, the step proceeds to a step S12, and an extremely small and minimum fixed amount of injection is performed by MPI to ensure the function of MPI. Accordingly, the remaining fuel injection amount, that is, the fuel injection amount obtained by subtracting the fixed amount with respect the requested fuel injection amount determined in accordance with the engine operation condition is performed by GDI. Here, the fixed amount of MPI is a minimum fuel injection amount ensuring the function of MPI, and it is set to a minimum fuel injection amount capable of ensuring the function of port injection fuel injection valve 9, or it may be set to a minimum fuel injection amount in which clogging does not occur.

In a step S13, it is judged whether or not the operation region is an operation region in which multistage injection of GDI is performed. That is, as shown in FIG. 2, in first operation region R1, it is judged whether or not the operation region is multistage injection regions R1*a* and R1*b* in which the multistage injection is performed. More specifically, it is judged that the operation region is high load side region R1*a* in which the multistage injection is performed to avoid oil dilution or low load side region R1*b* in which the multistage injection is performed to avoid deterioration of exhaust emission and deterioration of fuel economy caused by penetration of the direct injection. If it is judged that the operation region is multistage injection regions R1*a* and R1*b*, the step proceeds to a step S14, and the multistate injection in which the fuel injection of GDI is performed by dividing it into a plurality of times is performed. On the other hand, if the operation region is not multistage injection regions R1*a* and R1*b*, the step proceeds to a step S15, and a single-stage injection in which the total amount of GDI is injected at one time is performed.

In a case where it is judged that the operation region is not first operation region R1 in step S11, the step proceeds to a step S16, and it is judged whether or not the operation region is a second operation region R2. As shown in FIG. 2, this second operation region R2 is extremely low load side second operation region R2 in which the requested fuel injection amount is extremely small. More specifically, second operation region R2 is a region in which the requested fuel injection amount is smaller than a value obtained by adding the fixed amount of MPI and the minimum fuel injection amount of direct injection fuel injection valve 8. In a case where the operation region is this second operation region R2, the step proceeds to a step S17, and the port injection (MPI) is prohibited, and only the direct injection (GDI) is performed according to the requested fuel injection amount. In this way, in the extremely low load side in which the requested fuel injection amount is small, MPI is prohibited, and the fuel injection amount is covered by only GDI, and consequently, while the fuel injection amount is small, it is possible to enhance setting accuracy of the fuel injection amount.

In a case where it is judged that the operation region is not second operation region R2 in step S16, the step proceeds to a step S18, and it is judged whether or not the operation region is a third operation region. As shown in FIG. 2, this third operation region R3 is a region on a low and middle rotation and high load side, and is an operation region in which the fuel injected from the port injection fuel injection valve 9 is possibly blown off to an exhaust passage side during a valve overlap period in which both of the intake valve and the exhaust valve are opened. Accordingly, to avoid this blow-off of the fuel in advance, in a case where it is judged that the operation region is the third operation region, the step proceeds to a step S19, and MPI is prohibited, and the total amount of the requested fuel injection amount is injected by only GDI.

In a case where it is judged that the operation region is not third operation region R3 in step S18, the step proceeds to a step S20, and it is judged whether or not the operation region is a fourth operation region R4. This fourth operation region R4 is a high rotation and high load side region in which the requested fuel injection amount exceeds the maximum fuel injection amount of direct injection fuel injection valve 8. In a case where the operation region is fourth operation region R4, the step proceeds to a step S21, and a fuel injection amount corresponding to an amount obtained by subtracting the maximum fuel injection amount of direct injection fuel injection valve 8 from the requested fuel injection amount is injected by port injection fuel injection valve 9, while maintaining the fuel injection amount of direct injection fuel injection valve 8 at the maximum fuel injection amount. In this way, the shortage of GDI is covered by MPI, and thereby it becomes possible to improve the maximum output of the engine by securing a required fuel injection amount, while using relatively small-sized direct injection fuel injection valve 8.

In a case where it is judged that the operation region is not forth operation region R4 in step S20, the step proceeds to a step S22, and it is judged whether or not the engine operation condition is during idling operation, that is, the operation region is an idling operation region R5. If it is idling operation region R5, the step proceeds to a step S23, and to suppress torque fluctuation caused by the switching between the direct injection and the port injection, only either one of the direct injection or the port injection is operated. In this embodiment, only the direct injection (GDI) which is superior in responsiveness and combustion controllability is performed.

As the above, in the present embodiment, as compared with the port injection, the direct injection is superior in responsiveness, and moreover, it is superior in combustion controllability because fuel injection timing is close to ignition timing, and stratified charge combustion can be realized. Therefore the direct injection covers most of the fuel injection amount in most of the operation regions including first operation region R1, and thereby it becomes possible to improve combustion stability and controllability. Moreover, in the present embodiment, the fixed amount of the port injection is performed and the remaining fuel injection is performed by the direct injection in large operation region R1 except operation regions R2 to R5. Consequently, it becomes possible to suppress occurrence of failures such as the clogging caused by not performing the port injection for a long time period, by increasing frequency and opportunity of the port injection performance while maintaining the ratio of the fuel injection by the port injection to a minimum. In addition, by maintaining the port injection at the fixed amount, it is only necessary to adjust only the fuel injection amount of the direct injection according to the requested fuel injection amount, and as compared with a case where the fuel injection amounts of both of the port injection and the direct injection are adjusted according to the requested fuel injection amount, control of the fuel injection amount is simplified, and variation of the requested fuel injection amount is suppressed, and the setting accuracy of the requested fuel injection amount can be enhanced.

In addition, although one preferable embodiment of the present invention has been explained in detail, this invention is not limited to the above embodiment, and various modification can be possible. For example, in the idling operation condition, only the direct injection which is superior in responsiveness and combustion controllability is performed. However, only the port injection which is superior in silence may be performed in the idling operation condition.

The invention claimed is:

1. A control device for an internal combustion engine including a fuel injection valve for direct injection that injects fuel into a combustion chamber and a fuel injection valve for port injection that injects the fuel into an intake port, wherein the control device is configured to calculate a requested fuel injection amount according to an engine operation condition;

control a fuel injection amount of the direct injection fuel injection valve on a basis of the requested fuel injection amount and a minimum fuel injection amount of the port injection fuel injection valve, while maintaining a fuel injection amount of the port injection fuel injection valve at the minimum fuel injection amount of the port injection fuel injection valve, in a predetermined first operation region determined from an engine load and an engine rotation speed; and prohibit the injection of the port injection fuel injection valve, and perform fuel injection by only the direct injection fuel injection valve according to the requested fuel injection amount, in a second operation region in which the requested fuel injection amount is smaller than a value obtained by adding the minimum fuel injection amount of the port injection fuel injection valve and a minimum fuel injection amount of the direct injection fuel injection valve, the second operation region which is a lower load side than the first operation region.

2. The control device for the internal combustion engine according to claim 1, wherein in the first operation region, the fuel injection by the direct injection fuel injection valve is performed by dividing it into a plurality of times according to the engine operation condition.

3. The control device for the internal combustion engine according to claim 1, wherein in a third operation region in which the fuel injected from the port injection fuel injection valve is possibly blown off to an exhaust passage side during a valve overlap period in which both intake valve and exhaust valve are opened, the injection of the port injection fuel injection valve is prohibited, and the fuel injection is performed by only the direct injection fuel injection valve according to the requested fuel injection amount.

4. The control device for the internal combustion engine according to claim 1, wherein in a fourth operation region in which the requested fuel injection amount exceeds a maximum fuel injection amount of the direct injection fuel injection valve, a fuel injection amount corresponding to an amount obtained by subtracting the maximum fuel injection amount of the direct injection fuel injection valve from the requested fuel injection amount is injected by the port injection fuel injection valve, while maintaining the fuel injection amount of the direct injection fuel injection valve at the maximum fuel injection amount.

5. The control device for the internal combustion engine according to claim 1, wherein only either one of the direct injection fuel injection valve or the port injection fuel injection valve is operated during idling operation.

6. A control method for an internal combustion engine including a fuel injection valve for direct injection that injects fuel into a combustion chamber and a fuel injection valve for port injection that injects the fuel into an intake port, the method comprising:

calculating a requested fuel injection amount according to an engine operation condition;

controlling a fuel injection amount of the direct injection fuel injection valve on a basis of the requested fuel injection amount and a minimum fuel injection amount of the port injection fuel injection valve, while maintaining a fuel injection amount of the port injection fuel injection valve at the minimum fuel injection amount of the port injection fuel injection valve, in a predetermined first operation region determined from an engine load and an engine rotation speed; and prohibiting the injection of the port injection fuel injection valve, and performing the fuel injection performed by only the direct injection fuel injection valve according to the requested fuel injection amount, in a second operation region in which the requested fuel injection amount is smaller than a value obtained by adding the minimum fuel injection amount of the port injection fuel injection valve and a minimum fuel injection amount of the direct injection fuel injection valve, the second operation region which is a lower load side than the first operation region.

* * * * *